US006127324A

United States Patent [19]

Tolfa et al.

[11] Patent Number: 6,127,324

[45] Date of Patent: Oct. 3, 2000

[54] LUBRICATING COMPOSITION CONTAINING A BLEND OF A POLYALKYLENE GLYCOL AND AN ALKYL AROMATIC AND PROCESS OF LUBRICATING

[75] Inventors: John C. Tolfa; Kenneth C. Lilje, both of Midland, Mich.

[73] Assignee: The Lubrizol Corporation, Wickliffe, Ohio

[21] Appl. No.: 09/253,605

[22] Filed: Feb. 19, 1999

[51] Int. Cl.[7] ..... C10M 111/02

[52] U.S. Cl. ..... 508/463; 508/465; 508/579

[58] Field of Search ..... 508/463, 579, 508/465; 252/73, 79; 585/10, 25

[56] References Cited

U.S. PATENT DOCUMENTS

| | | | |
|---|---|---|---|
| 2,407,645 | 9/1946 | Bersworth | 260/434 |
| 3,865,743 | 2/1975 | Sheratte | 252/78 |
| 4,302,343 | 11/1981 | Carswell et al. | 252/33.4 |
| 4,714,794 | 12/1987 | Yoshida et al. | 252/73 |
| 4,954,325 | 9/1990 | Rubin | 502/64 |
| 5,326,485 | 7/1994 | Cervenka et al. | 508/463 |
| 5,602,086 | 2/1997 | Le et al. | 508/591 |
| 5,773,393 | 6/1998 | Adams | 508/551 |
| 5,783,528 | 7/1998 | Rodenbery | 508/485 |

FOREIGN PATENT DOCUMENTS 2-286792 11/1990 Japan .

OTHER PUBLICATIONS

Article 128:232469z: Development of refrigeration oil for alternative refrigerant, H. Takahashi, CA Selects: Lubricants, Greases & lubrication Issue 11, 1998.

Article 128:232471u: Refrigerator oils for natural refrigerants, W. Bock, CA Selects: Lubricants, Greases & lubrication Issue 11, 1998.

Article 128:232472v: Lubricants for the use with carbon dioxide as refrigerant, J. Fahl, CA Selects: Lubricants, Greases & lubrication Issue 11, 1998.

*Primary Examiner*—Margaret Medley
*Attorney, Agent, or Firm*—Samuel B. Laferty; Michael F. Esposito; Beverly A. Pawlikowski

[57] ABSTRACT

The present invention relates to a lubricating basestock comprising a blend of (A) at least one polyalkylene glycol and (B) at least one alkyl aromatic. Additives, such as antioxidants, corrosion inhibitors, and metal deactivators, can be added to the lubricating basestock. In one embodiment, the lubricating composition is free of naphthol. The blend can also be used in combination with a variety of oils of lubricating viscosity, with or without additives therein. According to the present invention, the lubricating composition exhibits excellent oxidation and thermal stability, demulsibility, and hydrolytic stability. The lubricating composition is particularly useful as a positive displacement compressor lubricant.

18 Claims, No Drawings

LUBRICATING COMPOSITION CONTAINING A BLEND OF A POLYALKYLENE GLYCOL AND AN ALKYL AROMATIC AND PROCESS OF LUBRICATING

TECHNICAL FIELD

The present invention relates to a lubricating basestock and a lubricating composition containing a blend of a polyalkylene glycol and an alkyl aromatic. In a preferred embodiment, the alkyl aromatic is an alkyl naphthalene. The basestock can be used alone or in combination with oils of lubricating viscosity, with or without additives, to form the lubricating composition. The compositions are particularly useful for environments having high temperature and high pressure conditions, such as when operating a positive displacement compressor, such as a reciprocating rotary vane, scroll, or rotary screw air compressor.

BACKGROUND OF THE INVENTION

Lubricating oils have been used in the past to lubricate the bearings of positive displacement compressors, to seal the rotors, and to cool the compressed gases. Lubricating oils typically used in the industry comprise a mineral oil or synthetic oil as a base oil, and various additives for a particular purpose. Oxidation stability and varnish and deposit control are some of the important properties desirable in a lubricant for maximizing-the life of the lubricant, and hence, the life of the equipment, especially under the high temperature and pressure conditions created when operating a positive displacement compressor, such as a reciprocating rotary vane, scroll, or rotary screw air compressor.

It has also been desirable in the industry to provide a lubricating composition which does not deteriorate due to high temperatures. Thermal stability of a lubricating oil is therefore sought after. There is also a need for a lubricating composition exhibiting demulsibility and hydrolytic stability, particularly under high temperature and pressure conditions.

Japanese Patent No. 2-286792, published on Nov. 26, 1990, is directed to preventing oxidation deterioration; Specifically, it relates to a lubricating oil composition comprising, as an essential component, 1-naphthol, blended in a base oil containing 5% by weight or more of an alkyl naphthalene. Japanese Patent No. 2-286792 forms a 1-naphthol/alkyl aromatic blend, and adds this blend to any material suitable for use as a lubricating oil.

SUMMARY OF THE INVENTION

The present invention relates to a lubricating basestock comprising a blend of (A) at least one polyalkylene glycol and (B) at least one alkyl aromatic. Additives, such as antioxidants, corrosion inhibitors, and metal passivitors, can be added to the lubricating basestock. In one embodiment, the lubricating composition is free of naphthol. The blend can also be used in combination with a variety of oils of lubricating viscosity, with or without additives therein.

According to the present invention, the lubricating composition exhibits improved oxidation and thermal stability, demulsibility, and hydrolytic stability. The lubricating composition is particularly useful as a positive displacement compressor lubricant, such as a reciprocating rotary vane lubricant, a scroll lubricant, or a rotary screw air compressor lubricant.

DETAILED DESCRIPTION OF THE PREFERRED EMBODIMENTS

Lubricating basestocks

The lubricating basestocks of this invention are useful as thermally and oxidatively stable lubricants. They can be used alone as a lubricant, or they can be combined with at least one oil of lubricating viscosity, including natural and synthetic lubricating oils, and mixtures thereof. The lubricating basestocks of the present invention can also be combined with additives or both oils and additives.

The lubricating basestock comprises a blend of (A) at least one of a polyalkylene glycol and (B) at least one of an alkyl aromatic.

The polyalkylene glycol has a number average molecular weight of about 200 to about 8000, preferably about 500 to 5000. Here, as well as elsewhere in the specification, the ratio and range limits may be combined.

The polyaklyene glycol or derirative there of has a kinematic viscosity at 40° C. of about 15 to about 500 cSt, preferably of about 22 to about 500 cSt, more preferably of about 22 to about 370 cSt, and most preferably of about 22 to about 220 cSt.

In a preferred embodiment, component (A) is a polyalkylene glycol represented by the following formula:

$$Z—(—(CHR_1—CHR_2—O)_n—R_3)_m$$

wherein Z is a residue of a non-amine initiator having from 1–8 active hydrogens, and $R_1$ and $R_2$ are independently H, or an alkyl. In one embodiment, the alkyl has from 1 to about 8 carbon atoms. In another embodiment, the alkyl is $CH_3$ or $CH_2CH_3$. The integer n has a value from 8 to 25, preferably from 10 to 20. The number average molecular weight of the polyalkylene glycol is from about 200 to about 8,000, preferably from about 500 to about 5000. $R_3$ is H, an alkyl having from about 1 about 30 carbons, preferably from about 1 to about 24 carbons, more preferably from about 1 to about 12 carbons, and most preferably from about 1 to about 6 carbons, or an acyl having from about 1 to about 30 carbons, preferably from about 1 to about 24 carbons, more preferably from about 1 to about 12, and most preferably from about 1 to about 6 carbons, and m is from 1 to 8. In another preferred embodiment, $R_1$ is H or $CH_3$ when $R_2$ is $CH_3$, and $R_2$ is H or $CH_3$ or $CH_2CH_3$ when $R_1$ is H.

Although component (A) can be prepared in a number of ways, suitable examples of component (A) are polyalkylene glycols prepared with initiators containing from 1–8 active hydrogens prepared from alkylene oxides having from 2 to about 12 carbons, including ethylene oxide, propylene oxide or butylene oxide. The oxides may be polymerized alone (homopolymers) or as mixtures (co- or tri-polymers). Another suitable polyalkylene glycol is prepared from a non-amine initiator having 1–4 active hydrogens, and having a kinematic viscosity at 40° C. of about 22 to about 220 cSt. Commercially available examples of polyalkylene glycols used for component (A) are WI 165® and WI 285®, available at BASF.

The meaning of the term "non-amine initiator" is explained as follows. Polyalkylene glycols are polymeric products where the monomers are epoxides of low carbon number olefins (ethylene, propylene, and butylene oxides are the typical ones used). An initiator must be used to start the polymerization reaction which is used to prepare the basestock products. The initiators are typically described as chemicals having active hydrogens. This means chemicals which have hydrogens which can be relatively easily removed with base. Active hydrogens are ones which are bonded to heteroatoms (e.g. oxygen, nitrogen, sulphur, phosphorous). It is common in the industry when making polyalkylene glycols to use oxygen initiators, referred to as non-amine initiators, (alcohols, water, diols, glycerols and/or other polyols), although some products are made using nitrogen initiators, referred to as amine initiators, (alkyl amines, aryl amines, diamines, and polyamines). Sulfur and phosphorous initiators are not typically used to make polyalkylene glycols. U.S. Pat No. 4,302,343 sets forth oxidation stability data showing that amine initiated polyalkylene glycols are not oxidatively stable even when typical antioxidant packages are present. The present invention therefore utilizes non-amine initiators.

The basestock, as described earlier, also includes component (B), at least one alkyl aromatic. The alkyl aromatics used in this invention have a kinematic viscosity at 40° C. of about 5 cSt to about 800 cSt, preferably from about 15 to about 500 cSt, and most preferably from about 15 cSt to about 220 cSt, and are selected from alkyl benzenes, alkyl naphthalenes, alkyl anthracenes, and alkyl phenanthrenes, or mixtures thereof. Commercially available examples of such alkyl aromatics are RF 150® and RF 300®, available at Soltex, and Zerol 150®, Zerol 300®, and Zerol 500®, available at Shrieve Chemical. The preferred alkyl aromatics are alkyl naphthalenes. Commercially available examples of such alkyl naphthalenes are MCP 917® and MCP-968®, available at Mobil Chemical.

In one embodiment, the alkyl aromatic is one formed from alkylating agents having from 1 to about 6 carbon atoms, preferably from 1 to about 12 carbon atoms, and most preferably from 1 to about 24 carbon atoms. In another embodiment, the alkyl aromatic used in the basestock is mono or di alkylated with an alkylating agent, forming an alkyl aromatic having one or more alkyl groups having from about 6 to about 30 carbons, and having a kinematic viscosity at 40° C. of about 15 cSt to about 500 cSt. A preferred alkyl naphthalene is one that has been mono or di alkylated with an alkylating agent, and having from about 10 to about 20 carbon atoms and a kinematic viscosity at 40° C. of from about 15 cSt to about 220 cSt.

The alkyl aromatic, such as an alkyl naphthalene, may be conveniently prepared using any suitable means known in the art, typically by Friedel-Crafts alkylation reactions. Non limiting examples of zeolites employed as Friedel-Crafts catalysts are shown in U.S. Pat. No. 4,714,794. The use of zeolite MCM-22 is set forth in U.S. Pat. No. 4,954,325, which produces particularly linear alkyl substituents having good lubricant properties and good oxidative and thermal stability. Both of these patents are hereby incorporated by reference in their entirety.

Blends of the foregoing polyalkylene glycols and alkyl aromatics in the lubricating basestock range from about 95% to about 5% polyalkylene glycol and from about 5% to about 95% alkyl aromatic, based upon the total weight of the polyalkylene glycol/alkyl aromatic blend. Preferable ranges are from about 95% to about 45% polyalkylene glycol and from about 5% to about 55% alkyl aromatic, based upon the total weight of the blend. Most preferable ranges are from about 95% to about 60% polyalkylene glycol and from about 5% to about 40% alkyl aromatic, based upon the total weight of the blend.

Lubricating Composition

As discussed earlier, the lubricating basestock blend of this invention can be used alone, or can be combined with one or more oils of lubricating viscosity, including natural and synthetic lubricating oils, and mixtures thereof, with or without additives. The basestock blend can be combined with both oils of lubricating viscosity and additives. When combined with other components, the amount of lubricating basestock blend used according to the present invention is from about 10% to about 99%, preferably from about 20% to about 90% of the total weight of the lubricating composition.

Suitable mineral oils that can be used in conjunction with the basestock of the present invention include those having a viscosity range from about 20 to about 60 cSt at 40° C., preferably from about 30 cSt to about 40 cSt at 40° C. Such oils are refined from crude oil of any source. Standard refinery operations may be used in processing the mineral oil. Among the general types of petroleum oils useful in the compositions of this invention are solvent neutrals, bright stocks, cylinder stocks, residual oils, hydrocracked basestocks, and paraffin oils including pale oils. Such oils and blends of them are produced by a number of conventional techniques which are widely known by those skilled in the art.

Suitable synthetic lubricating oils include hydrocarbon oils and halo-substituted hydrocarbon oils such as polymerized and interpolymerized olefins [e.g., hydrogenated polybutylenes, hydrogenated polypropylenes, hydrogenated propylene-isobutylene copolymers, chlorinated hydrogenated polybutylenes, hydrogenated poly(1-hexenes), hydrogenated poly(1-octenes), hydrogenated poly(1-decenes)]; alkylbenzenes [e.g., dodecylbenzenes, tetradecylbenzenes, dinonylbenzenes, di(2-ethylhexyl) benzenes]; polyphenyls (e.g., biphenyls, terphenyls, alkylated polyphenyls); and alkylated diphenyl ethers and alkylated diphenyl sulfides and the derivatives, analogs and homologs thereof.

Polyalkylene glycols other than those used for component (A) of the present invention that are useful as oils of lubricating viscosity include alkylene oxide polymers and interpolymers and derivatives thereof where the terminal hydroxyl groups have been modified by esterification, etherification. These constitute another class of known synthetic lubricating oils. These are exemplified by polyoxyalkylene polymers prepared by polymerization of ethylene oxide or propylene oxide, the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500); and mono- and polycarboxylic esters thereof, for example, the acetic acid esters, mixed $C_3$—C8 fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and hydrogenated alkenyl succinic acids, maleic acid, azelaic acid, suberic acid, sebacic acid, fumaric acid, adipic acid, linoleic acid dimer, malonic acid, alkylmalonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol and tripentaerythritol.

Silicon-based oils such as the polyalkyl-, polyaryl-, polyalkoxy-, or polyaryloxysiloxane oils and silicate oils comprise another useful class of synthetic lubricants; they include tetraethyl silicate, tetraisopropyl silicate, tetra-(2-ethylhexyl) silicate, tetra-(4-methyl-2-ethylhexyl) silicate, tetra-(p-tert-butylphenyl) silicate, hexa-(4-methyl-2-pentoxy)disiloxane, poly(methyl)siloxanes and poly (methyl-phenyl) siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

Typical vegetable oils that may be used as base oils or as components of the base oils include castor oil, olive oil, peanut oil, rapeseed oil, corn oil, sesame oil, cottonseed oil, soybean oil, sunflower oil, safflower oil, hemp oil, linseed oil, tung oil, oiticica oil, jojoba oil, meadowfoam oil, and the like. Such oils may be partially or fully hydrogenated, if desired.

The fact that the base oils used in the compositions of this invention may be composed of (i) one or more mineral oils, (ii) one or more synthetic oils, (iii) one or more vegetable oils, or (iv) a blend of (i) and (ii), or (i) and (iii), or (ii) and (iii), or (i), (ii) and (iii) does not mean that these various types of oils are necessarily equivalents of each other. Certain types of base oils may be used in certain compositions for the specific properties they possess such as biodegradability, high temperature stability, non-flammability or lack of corrosivity towards specific metals (e.g. silver or cadmium). In other compositions, other types of base oils may be preferred for reasons of availability or low cost. Thus, the skilled artisan will recognize that while the various types of base oils discussed above may be used in the compositions of this invention, they are not necessarily functional equivalents of each other in every instance. Oils of lubricating viscosity that cannot be used are those that are not miscible with one another.

Additives

As aforementioned, the lubricating basestock or lubricating composition according to the present invention may also contain effective amounts of additives such as antioxidants, rust and corrosion inhibitors, metal deactivators, lubricity additives, antiwear additives, or such additives as may be required. Commercially available examples of antiwear additives are additives such as tricresyl phosphate (TCP) available at Syn-O-Add, 8484® available at Akzo-Nobel, or triphenyl phosphorothionate (TPPT) available at Ciba Geigy. In general, the finished lubricant composition will contain the additive components in minor amounts sufficient to improve the performance characteristics and properties of the oil of lubricating viscosity or basestock blend, or to both the base oil and basestock blend. The amounts of the respective components may vary in accordance with such factors as the type and characteristics of the base oil or basestock blend employed, the type and severity of the service conditions for which the finished product is intended, for example, for use in a positive displacement compressor, such as a rotary screw compressor, a reciprocating rotary vane, or scroll, and the specific performance properties desired in the finished product. The lubricating composition, however, does not contain naphthol. In one embodiment, the lubricating composition consists essentially of a blend of (A) at least one polyalkylene glycol and (B) at least one alkyl aromatic, having excellent oxidation stability and thermal stability, and exhibiting excellent demulsibility and hydrolytic stability, particularly under high temperature and pressure conditions.

Generally, additives used for their known purpose can comprise from about 10% to about 0.01% by weight of the total weight of the lubricant composition, and preferably from about 5% to about 0.001% by weight based on the total weight of the lubricating composition.

Examples of useful antioxidants include phenyl naphthyl amines (alpha and/or beta), diphenyl amines, including alkylated diphenyl amines. Commercially available examples of such antioxidants are Irganox L-57® ( available at Ciba Geigy, and Valube 81® ( available at Vanderbilt Chemical. Suitable antioxidants are also exemplified by phenolic antioxidants, aromatic amine antioxidants, sulfurized phenolic antioxidants, and organic phosphites, among others. Examples of the phenolic antioxidants include 2,6-di-tert-butylphenol, liquid mixtures of tertiary butylated phenols, 2,6-di-tert-butyl-4-methylphenol, 4,4'-methylenebis(2,6-di-tert-butylphenol), 2,2'-methylenebis(4-methyl-6-tert-butyl-phenol), mixed methylene-bridged polyalkyl phenols, and 4,4'-thiobis(2-methyl-6-tert-butylphenol). N,N'-Di-see-butyl-p-phenylenediamine, 4-isopropylaminodiphenyl amine, phenyl-alpha-naphthyl mine, phenyl-beta-naphthyl amine, and ring-alkylated diphenylamines serve as examples of aromatic amine antioxidants. Commercially available antioxidants useful for the present invention also include Ethanoxo® 702 available at the Ethyl Corporation, Irganox® L-135 and lrganox® L-118, Irganox L-06® available at Ciba Geigy, and RC-7130® available at Rhein Chemie.

Examples of suitable rust and corrosion inhibitors are neutral metal sulfonates such as calcium sulfonate, magnesium sulfonate, sodium sulfonate, barium dinonylnaphthalene sulfonate, and calcium petroleum sulfonate. Other types of rust or corrosion inhibitors which may be used comprise monocarboxylic acids and polycarboxylic acids. Examples of suitable monocarboxylic acids are oleic acids, octanoic acid, decanoic acid and dodecanoic acid. Suitable polycarboxylic acids include dimer and trimer acids such as are produced from such acids as tall oil fatty acids, oleic acid, and linoleic acid. Also useful are carboxylic acid based, metal free materials, such as hydroxy alkyl carboxylic esters. Another useful type of rust inhibitor for use in the practice of this invention is comprised of the alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having about 8 to about 24 carbon atoms in the alkenyl group with alcohols such as the polyglycols. Other suitable rust or corrosion inhibitors include ether amines; acid phosphates; amines; polyethoxylated compounds such as ethoxylated amines, ethoxylated phenols, and ethoxylated alcohols; imidazolines; and aminosuccinic acids or derivatives thereof. Mixtures of such rust or corrosion inhibitors can be used. U.S. Pat. No. 5,773,393 is incorporated in its entirety herein for its disclosure regarding rust and corrosion inhibitor additives. A commercially available example of a corrosion inhibitor is L-859® available at the Lubrizol Corporation.

Examples of suitable metal deactivators are complex organic nitrogen, oxygen and sulfur-containing compounds. For copper, compounds such as substituted benzotriazole, alkyl or acyl substituted 5,5'-methylene-bis-benzotriazole, alkyl or acyl substituted 2,5-dimercaptothiazole, salts of salicylaminoguanidine, and quinizarin are useful. Propylgallate is an example of a metal deactivator for magnesium, and sebacic acid is an example of a deactivator for lead. A commercially available example of a triazole metal deactivator is Irgamet 39® available at Ciba Geigy.

An effective amount of the foregoing additives is generally in the range from about 0.005% to about 5% by weight of the total weight of the lubricant composition for the antioxidants, from about 0.005% to about 0.5% percent by weight based on the total weight of the lubricant composition for the corrosion inhibitors, and from about 0.001% to about 0.5% percent by weight of the total weight of the lubricant composition for the metal deactivators. It is to be understood that more or less of the additives may be used depending upon the circumstances for which the lubricant compositions are to be used.

The lubricating compositions of this invention when used in a positive displacement compressor, such as a reciprocating rotary vane, a scroll, or a rotary screw air compressor, are selected so as to have a viscosity in the range of about 10 to about 150 centistokes at 40° C., preferably from about 22 to about 100 centistokes at 40° C., and most preferably of about 32 to about 68 centistokes at 40° C., and a pour point in the range of about −10° C. to about −100° C., and preferably from about −20 to about −70° C.

The present invention also is directed to a process of lubricating a piece of equipment, for example, a positive displacement compressor such as a reciprocating rotary vane, a scroll, or a rotary screw air compressor, whereby the life of the lubricant and the equipment is maximized since the lubricant has excellent oxidative and thermal stability, and since it exhibits excellent demulsibility and hydrolytic stability, resulting in the reduction of formation of sludge, varnish, and other deposits that can reduce the life of a piece of equipment. A compressor operated according to the present invention operates longer than when using hydrocarbonbased lubricants. The composition of the present invention will not form solids resulting from polymerization of oxidation by-products often associated with hydrocarbon based lubricant failure. A compressor operated according to the present invention runs at a discharge operating temperature range of from about 150° F. to about 250° F. (about 65° C. to about 120° C.). The compressor can run as much at 24 hrs/day, seven days/wk, for many years. In the most extreme case, shutdown will occur only for maintenance.

The blends of the foregoing polyalkylene glycols and alkyl aromatics, with or without an oil of lubricating viscosity and additives, are useful in a variety of mechanical applications where thermal and oxidative stability, as well as demulsibility, and hydrolytic stability are desired, particularly under high temperature and pressure conditions. Such applications include power steering fluids, steam or gas turbine oils, compressor oils, hydraulic oils, and gear oils.

The blends of the foregoing polyalkylene glycols and alkyl aromatics are also useful in a variety of functional fluids including transformer oils, cutting fluids, brake fluids, heat transfer fluids, and secondary brines.

The following examples are presented to illustrate, but not limit, the lubricant composition according to the present invention.

TABLE 1

| Example | PAG | AN | DPA | PANA | PHEN | L-859 | Triazole |
|---|---|---|---|---|---|---|---|
| 1 | 70% 165 | 30% MCP | 1% | | | 0.04% | 0.02% |
| 2 | 70% 285 | 30% MCP | 1% | | | 0.04% | 0.02% |
| 3 | 70% 285 | 30% MCP | | 1% | | 0.04% | 0.02% |

TABLE 1-continued

| Example | PAG | AN | DPA | PANA | PHEN | L-859 | Triazole |
|---|---|---|---|---|---|---|---|
| 4 | 70% 285 | 30% MCP | 0.75% | 0.5% | | 0.04% | 0.02% |
| 5 | 70% 285 | 30% MCP | 1% | | 0.5% | 0.04% | 0.02% |

PAG 165 is polyalkylene glycol ISO viscosity grade 32 (a polypropylene glycol)
PAG 285 is polyalkylene glycol ISO viscosity grade 46 (a polypropylene glycol)
AN is alkyl napthalene according to the present invention
DPA is diphenyl amine
PANA is phenylαnaphthyl amine
PHEN is a hindered phenolic antioxidant
L-859 is a carboxylic acid based corrosion inhibitor
MCP is MCP 917, an alkyl naphthalene alkylated with $C_{14}$ In Table 1, the 70 and 30 are the ratios of the polyalkylene glycol and alkyl naphthalene in the lubricating blend. Therefore, "70" and "30" represent the amount of each blend component based on the total weight of the blend. Additives are added to this blend to make the lubricating composition. The amount of additive levels in Table 1 therefore represent the amount of each additive that is added, based upon the total weight of the lubricating composition comprising the blend and the additives.

Examples 1–5 of Table 1 illustrate two types of polyalkylene glycols, that is, PAG 165 and PAG 285, each used with a number of different antioxidant formulations. All of these formulations achieve superior performance compared to the commercially available Sullube formula, illustrated in Table 2 below. Table 2 shows that the basestock blend (the polyalkylene glycol and alkyl naphthalene) of the present invention gives excellent performance, regardless of the antioxidant package.

Comparative Example

Sullube 32 is a Dow Product. The basestock is a polypropylene glycol blended with a polyol ester formulated with a diphenyl amine, a barium sulfonate based corrosion inhibitor, and a triazole.

Examples 1–5 of Table 1 and Comparative Example (Sullube 32) are compared below in Table 2.

Table 2 lists the results of the Cincinnati Millacron Test. The Cincinnati Millacron test is a measure of the thermal and oxidative stability of a lubricating composition. A sample of the lubricating composition touching copper and steel rod was heated at 275° F. in a convection oven. Samples were taken weekly and the total acid number (TAN) is measured. An increase in TAN indicates oxidation is occuring. The Cincinnati Millacron Test shows oxidation stability by acid number increase. A TAN of >1 is an unacceptable result. The values in Table 2 are the total acid number (mg KOH/g) after storage for the stated time at 275° F. in air.

TABLE 2

| Example | TAN initial | TAN Week 2 | TAN Week 4 | TAN Week 8 |
|---|---|---|---|---|
| Sullube 32 | 0.09 | 0.15 | 0.29 | 2.33 |
| 1 | 0.30 | 0.18 | 0.31 | 0.68 |
| 2 | 0.11 | 0.14 | 0.14 | 0.19 |
| 3 | 0.12 | 0.12 | 0.20 | 0.38 |

TABLE 2-continued

| Example | TAN initial | TAN Week 2 | TAN Week 4 | TAN Week 8 |
|---|---|---|---|---|
| 4 | 0.14 | 0.12 | 0.17 | 0.40 |
| 5 | 0.15 | 0.20 | 0.26 | 0.29 |

As Table 2 indicates, Examples 1, 2, 3, 4, and 5 according to the present invention achieve a TAN value of less than 1.0 through week 8. Comparative Example Sollube 32) has a TAN value of greater than 1.0 by week 8. Therefore, it is evident that the present invention achieves superior thermal and oxidation Examples 1 and 2 of the present invention are further compared with the Comparative Example (Sullube 32) with respect to demulsibility in Table 3 below. Demulsibility is determined by ASTM D-1401. This test shows how completely the tested lubricating composition separates from water. This test is particularly important for air compressor fluids because water is typically present in compressed be removed from the system. The test mixes 40 ml water and 40 ml oil. The values in Table 3 represent the ml of clear phase after the test. The time represents the time in minutes for the separation to occur. An ideal result is complete separation of the phases in the shortest period of time. Complete separation of the phases is desired for demulsibility.

TABLE 3

| Example | Oil | Water | Emulsion | Time |
|---|---|---|---|---|
| Sullube 32 | 39 | 39 | 2 | >30 min |
| Ex 1 (without additives) | 40 | 40 | 0 | 6 min |
| Ex 2 (without additives) | 40 | 40 | 0 | 7 min |
| Ex 1 (with additives) | 40 | 40 | 0 | 1 min |
| Ex 2 (with additives) | 40 | 40 | 0 | 1 min |

As Table 3 indicates, the present invention achieves desirable demulsibility as compared with the comparative example. That is, Table 3 indicates that phase separation is incomplete even after 30 minutes for Sullube 32, whereas complete separation occurs for Example 1 of the present invention, without additives, at 6 minutes, and for Example 2 of the present invention, without additives, at 7 minutes, and for Example 1 of the present invention, with additives, at 1 minute, and for Example 2 of the present invention, with additives, at 1 minute.

Although the invention has been shown and described with respect to certain preferred embodiments, it is obvious that equivalent alterations and modifications will occur to others skilled in the art upon the reading and the understanding of the specification. The present invention includes all such equivalent alterations and modifications, and is limited only by the scope of the claims.

What is claimed is:

1. A lubricating basestock comprising:

a blend of (A) from about 95% to about 45% of at a least one polyalkylene glycol or derivative thereof having the following formula:

$$Z—(—(CHR_1—CHR_2—O)_n—R_3)_m$$

wherein:

Z is a residue of a non-amine initiator having from 1–8 active hydrogens;

$R_1$ and $R_2$ are independently H or alkyl having from 1 to 8 carbon atoms;

n is an integer from 8 to 25;

$R_3$ is H, an alkyl having from 1 to 30 carbons, or an acyl having from 1 to about 30 carbons; and m is 1–8 and (B) from about 5% to about 55% of at least one alkyl aromatic, based on the total weight of said blend, wherein said alkyl aromatic is selected from alkyl anthracenes, alkyl phenanthrenes, and alkyl naphthalenes, and mixtures of two or more thereof.

2. The lubricating basestock of claim 1, wherein said lubricating basestock has a kinematic viscosity at 40° C. in the range of about 22 cSt to about 100 cSt.

3. The lubricating basestock of claim 1, wherein said $R_1$ and $R_2$ are selected from $CH_3$ and $CH_2CH_3$.

4. The lubricating basestock of claim 1, wherein $R_1$ is H or $CH_3$ when $R_2$ is $CH_3$, and $R_2$ is H, $CH_3$, or $CH_2CH_3$ when $R_1$ is H.

5. The lubricating basestock of claim 1, wherein n is an integer from 10 to 20.

6. The lubricating basestock of claim 1, wherein said polyalkylene glycol or derivative thereof has a number average weight of from about 200 to about 8000.

7. The lubricating basestock of claim 1, wherein said polyalkylene glycol or derivative thereof has a number average weight of from about 500 to about 5000.

8. The lubricating basestock of claim 1, wherein said polyalkylene glycol or derivative thereof has a kinematic viscosity at 40° C. of about 15 to about 500 cSt.

9. The lubricating basestock of claim 1, wherein said polyalkylene glycol or derivative thereof has a kinematic viscosity at 40° C. of about 22 to about 370 cSt.

10. The lubricating basestock of claim 1, wherein said polyalkylene glycol or derivative thereof has a kinematic viscosity at 40° C. of about 22 to about 220 cSt.

11. The lubricating basestock of claim 1, wherein said at least one alkyl aromatic has a kinematic viscosity at 40° C. of about 5 to about 800 cSt.

12. The lubricating basestock of claim 1, wherein said lubricating basestock has a pour point in the range of about −10° C. to about −100° C.

13. The lubricating basestock of claim 1, wherein said alkyl aromatic has one or more alkyl groups, said alkyl groups having from about 6 to about 30 carbon atoms.

14. A lubricating composition comprising a blend of (A) from about 95% to about 45% of at a least one polyalkylene glycol or derivative thereof having the following formula:

$$Z—(—(CHR_1—CHR_2—O)_n—R_3)_m$$

wherein:

Z is a residue of a non-amine initiator having from 1–8 active hydrogens;

$R_1$ and $R_2$ are independently H or alkyl having from 1 to 8 carbon atoms;

n is an integer from 8 to 25;

$R_3$ is H, an alkyl having from 1 to 30 carbons, or an acyl having from 1 to about 30 carbons; and m is 1–8 and (B) from about 5% to about 55% of at least one alkyl aromatic, based on the total weight of said blend, wherein said alkyl aromatic is selected from alkyl anthracenes, alkyl phenanthrenes, and alkyl naphthalenes, and mixtures of two or more thereof.

15. The lubricating basestock of claim 1, wherein said alkyl aromatic composes alkyl naphthalene.

16. A process of lubricating a positive displacement compressor comprising the step of applying in an effective lubricant amount said lubricating basestock of claim 1 to the positive displacement compressor.

17. The lubricating basestock according to claim 1, further comprising additives, wherein said additives are selected from antioxidants, rust and corrosion inhibitors, metal deactivators, lubricity additives, antiwear additives, or mixtures of two or more thereof.

18. The lubricating basestock of claim 1, wherein said lubricating basestock has a kinematic viscosity at 40° C. in the range of about 10 cSt to about 150 cSt.

* * * * *